US006835122B2

(12) United States Patent
Jäger

(10) Patent No.: US 6,835,122 B2
(45) Date of Patent: Dec. 28, 2004

(54) DEVICE FOR GRINDING AN EXTERNAL SLEEVE SURFACE

(75) Inventor: Manfred Jäger, Oberteuringen (DE)

(73) Assignee: Jaeger GmbH Roll Service, Oberteuringen (DE)

( * ) Notice: Subject to any disclaimer, the term of this patent is extended or adjusted under 35 U.S.C. 154(b) by 0 days.

(21) Appl. No.: 10/250,630

(22) PCT Filed: Dec. 17, 2001

(86) PCT No.: PCT/EP01/14883

§ 371 (c)(1),
(2), (4) Date: Dec. 30, 2003

(87) PCT Pub. No.: WO02/051585

PCT Pub. Date: Jul. 4, 2002

(65) Prior Publication Data

US 2004/0092212 A1 May 13, 2004

(30) Foreign Application Priority Data

Dec. 23, 2000 (DE) ..... 100 65 881

(51) Int. Cl.[7] ..... B24B 1/00
(52) U.S. Cl. ..... 451/49; 451/168

(58) Field of Search ..... 451/8, 49, 168, 451/142, 146, 254, 258, 290, 424, 439, 11

(56) References Cited

U.S. PATENT DOCUMENTS 3,839,941 A * 10/1974 Adams ..... 409/180
4,779,383 A * 10/1988 Vesterlund ..... 451/348
5,538,458 A * 7/1996 Maier ..... 451/11

FOREIGN PATENT DOCUMENTS

DE WO 9803304 * 1/1998 ..... B24B/5/04

* cited by examiner

*Primary Examiner*—Dung Van Nguyen
(74) *Attorney, Agent, or Firm*—Pandiscio & Pandiscio

(57) ABSTRACT

Device for grinding an external sleeve surface on a rotationally symmetrical body comprises a support frame displaceable along the external sleeve surface of the body and to which a driven belt grinder is fixed, and pivoted running rollers spaced in the circumferential direction of the body and resting on the external sleeve surface of the body, whereby a rapid and positionally exact grinding of the body is achieved.

15 Claims, 6 Drawing Sheets

DEVICE FOR GRINDING AN EXTERNAL SLEEVE SURFACE

BACKGROUND OF THE INVENTION (1) Field of the Invention

The invention relates to a device for grinding an external sleeve surface on a rotationally symmetrical body, in particular for grinding a roll on a paper machine, comprising a support frame, displaceable along the external sleeve surface of the body to which at least one driven belt grinder is fixed and several pivoted running rollers, laterally spaced in the circumferential direction of the body, resting on the external sleeve surface of the body.

(2) Description of the Prior Art

A belt grinding apparatus of prior art is familiar from WO 98/03304; this apparatus possesses a support frame in which a belt grinder is arranged. Two rollers are arranged on the side next to the belt grinder on the free end of the U-shaped support frame; these rollers are assigned to the body to be machined and are in contact with the surface of the roll. A further linkage is provided on the side next to one of the two rollers, the linkage possessing two rollers resting on rolls. One of the two rollers runs on the surface of a roll which is located at a distance from the roll to be machined. A drive device is arranged on one side of the support frame facing away from the rolls, so that the belt grinding apparatus can be moved along the outer external sleeve surface of the roll. The belt grinder is pressed against the roll to be machined by means of a pneumatic servo device in such a way that the servo device presses against the intrinsic weight of the support frame.

A device of this kind has proved to be disadvantageous in that reliable grinding and machining of the external sleeve surface of the roll cannot be guaranteed since the contact force is limited due to the arrangement of the device on the roll, which means the belt grinder can only be pressed against the external sleeve surface of the roll to an inadequate extent. As a result, all that can be achieved is to clean and polish the external sleeve surface of the roll.

The contact force generated by the servo device is insufficient, since the very light weight of the device is inadequate for contour grinding. However, the device is not guided in the axial direction, so that control of the device is imprecise and consequently no support is provided.

Furthermore, the device of prior art can only be used if there is a second, adjacent roll, because this device requires a back-up roller which is in contact with an adjacent roll. Otherwise, namely, the belt grinding apparatus would not be held against the external contour of the roll, but would slide instead. However, the laterally projecting framework constructions which prevent the belt grinding apparatus from slipping in this manner take up a lot of space, so that before the roll can be machined it is necessary to make sure that the device for grinding off material can be moved freely along the external contour of the roll. Under certain circumstances, this means that the rolls used in paper mills have to be removed, or at least that all other components in the area around the rolls have to be removed. However, the standstill time of the rolls must be kept as short as possible during machining since these paper machines must produce paper round the clock in order to operate profitably.

SUMMARY OF THE INVENTION

The purpose of the present invention is therefore to create a device for grinding an external sleeve surface of the aforementioned type, by means of which rapid and positionally accurate grinding of the external contour is guaranteed without the need to afford free access to the rotationally symmetrical body to be machined in a paper mill. Furthermore, it should be possible to move the device along the body straightforwardly and with positional accuracy in the direction of the longitudinal axis of the body.

In accordance with the present invention, this task is undertaken in that a fixed thrust bearing is assigned to the external sleeve surface to be machined, in that a calibration device is inserted in between the thrust bearing and the support frame connected to the latter and braced against the thrust bearing, and in that the contact pressure acting on the external sleeve surface and/or the advance movement of the belt grinder according to the given unevenness of the external sleeve surface and/or the measured eccentricity of the body can be adjusted using the calibration device, or that a support member is mounted on the support frame and that the free end of the support member is in movable contact with a thrust bearing arranged at an interval from the body.

Further advantageous embodiments of the invention are described in the subordinate claims.

In the first alternative of the device in accordance with the present invention for grinding down the external sleeve surface of a rotationally symmetrical body, it has proven to be beneficial for the support frame of the device to be braced against a thrust bearing, so that the advance movement and the contact pressure of the belt grinder can be applied in a defined manner since the force needed for advancing the belt grinder is absorbed by the thrust bearing. By this means, it is guaranteed that the grinding process can be performed quickly and reliably since the contact pressure and advance movement of the belt grinder can be set according to the given unevenness of the external sleeve surface.

Normally, it is possible to employ the shafts present in paper mills as the thrust bearing; these shafts being otherwise used for deflecting and drying nonwoven material and the support frame is braced against them. Possible geometrical discrepancies between the longitudinal axis of the shaft and the longitudinal axis of the rotationally symmetrical body can be compensated for by using the calibration device to alter the position of the support frame in relation to the external sleeve surface of the body. However, it has proven to be advantageous to have the configuration of the shaft identical in the most part to the geometrical track of the body to be machined, at least with regard to their common bowing along the longitudinal axis, with the result that compensation for faults is often not required.

If there is no thrust bearing immediately available, this can easily be provided by means of a tube or the like clamped between the support for the body to be machined. There is no need for extensive and time-consuming conversion or dismantling work because the grinding device is compact and therefore takes up little space.

In the second alternative of the device in accordance with the present invention, the contact pressure needed for grinding the roll is exclusively generated by means of the weight of the device which is supported against the external sleeve surface of the roll by means of running rollers. The evaluation and control unit is connected to the servo devices which lift or lift off the running rollers in such a way that the contact pressure of the belt grinder can be varied between the value zero and approximately the weight of the device.

The device is held against the external sleeve surface of the roll because the weight axis of the device runs in line with the weight axis of the roll and because the torque generated by the rotation of the roll and/or the belt grinder is braced against the thrust bearing arranged at an interval from the body. As a result, no other support devices are required.

Consequently, there is no need for dismantling work on the roll in order to be able to grind it down. Instead, the device can be placed onto the roll without any delay. The roll can also be driven by means of the motor attached to the device, thereby guaranteeing a very rapid and uncomplicated operating method of the device along the longitudinal axis of the body.

However, it is also theoretically possible for the device to be moved along the longitudinal axis of the body as a result of the rotation of the body if at least one running roller is oriented at an angle to the longitudinal axis.

BRIEF DESCRIPTION OF THE DRAWINGS

The drawing shows two sample embodiments configured in accordance with the present invention, the details of which are explained below. In the drawing.

DESCRIPTION OF THE INVENTION

Figure 1:
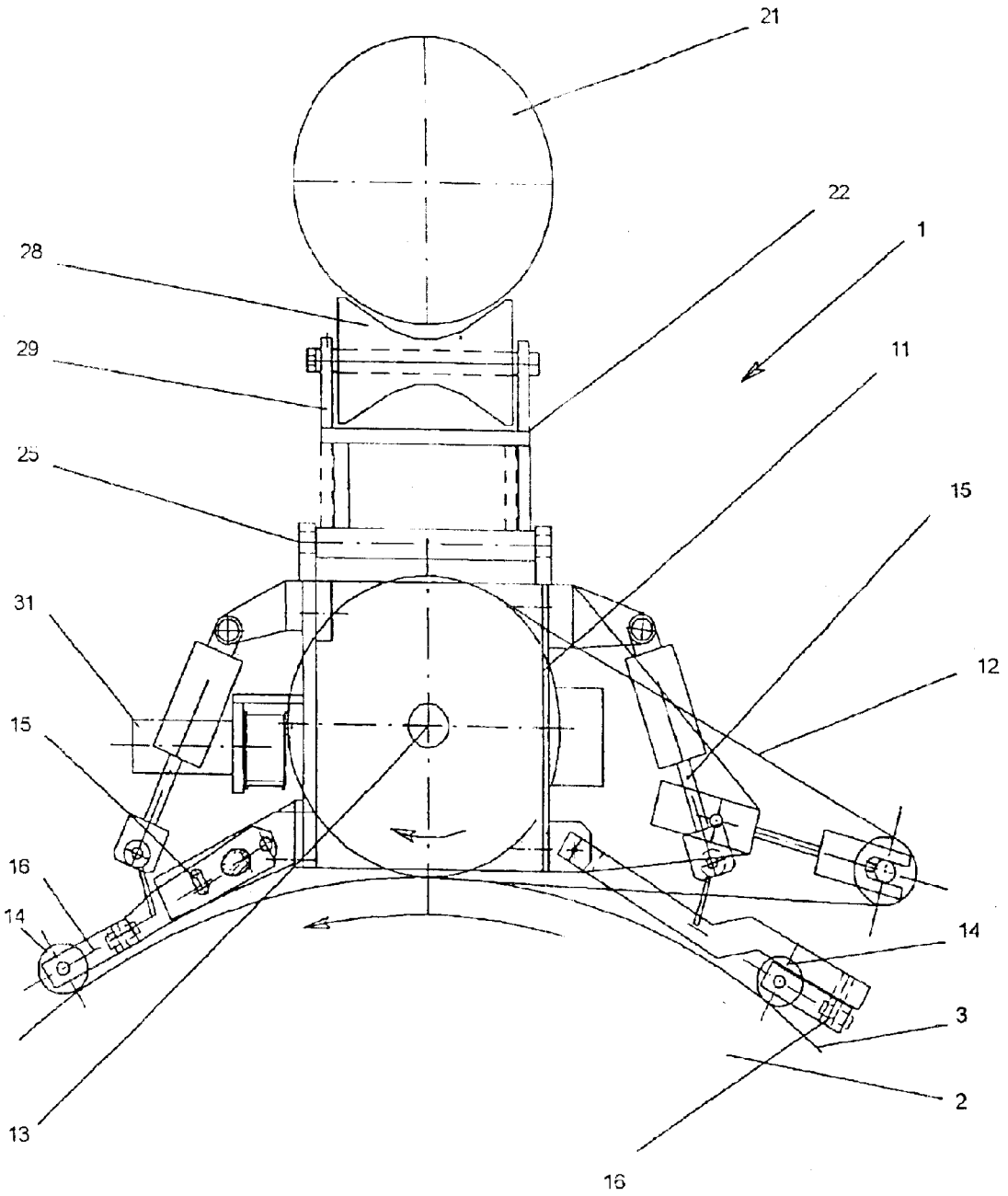
FIG. 1 shows a first embodiment of a device for grinding an external sleeve surface of a rotationally symmetrical body, as a side view.
Figure 2:
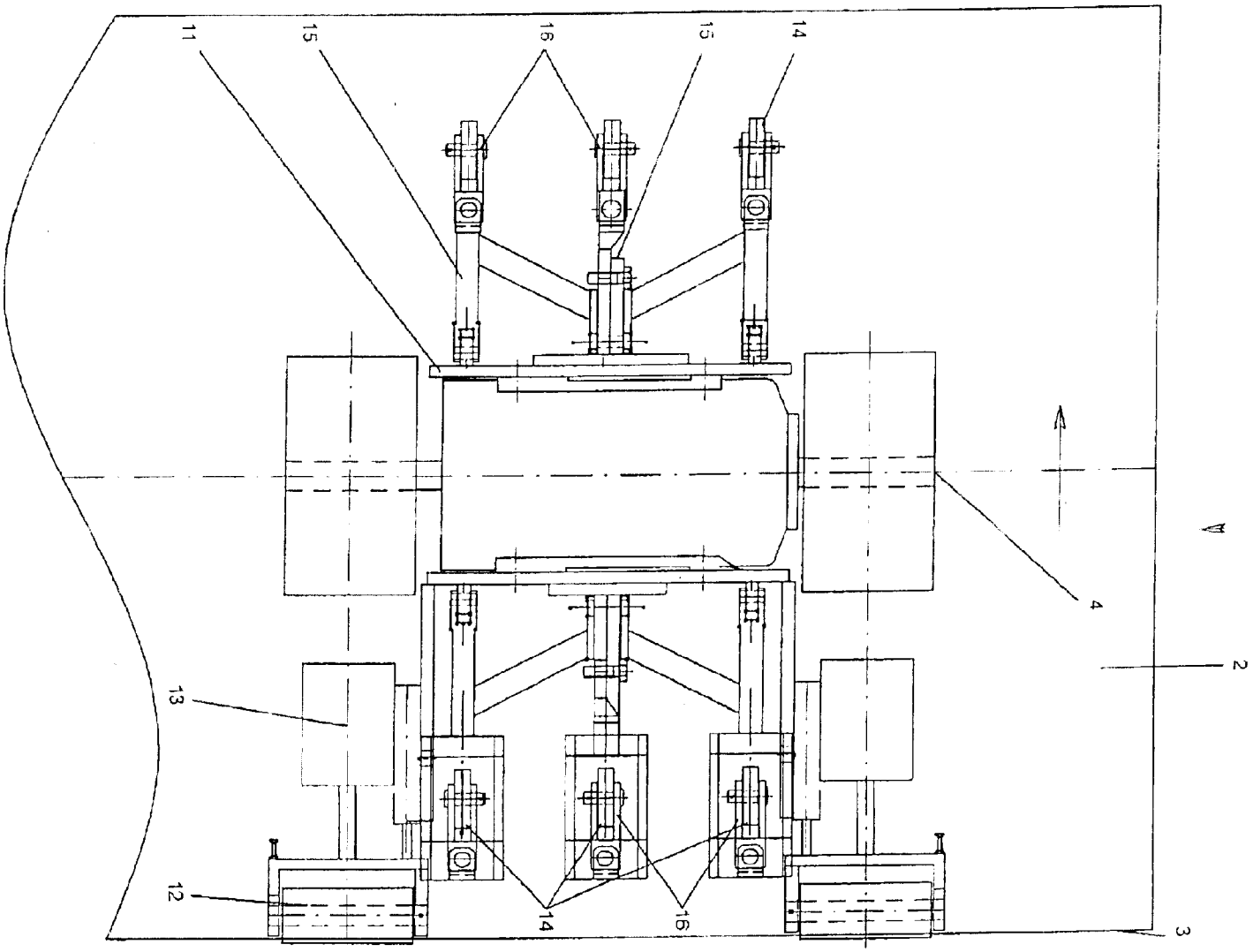
FIG. 2 shows the device according to FIG. 1, as a plan view.

FIGS. 1 and 2 show a device 1 for grinding an external sleeve surface 3 of a rotationally symmetrical body 2. The rotationally symmetrical body 2 is usually employed in a paper machine and is configured as a roll.

Following lengthy operation of the paper machine, it is necessary to grind down the external sleeve surface 3 of the body 2 in order to re-establish the concentricity of the body 2. Due to the long operating time of the paper machine and the permanent load, areas of unevenness are created on the external sleeve surface 3 which give rise to tears in the paper running around it. In order to machine the external sleeve surface 3, it is necessary to set the body 2 in rotation so that the device 1 is to be moved in a lengthways axis 4 of the body 2 along the external sleeve surface 3. This is achieved by having an advance motor 31 attached to the device 1, with the advance motor 31 being in a driven, force-locking active connection with a toothed belt (not illustrated) or the like. The toothed belt is firmly clamped between the supports of the paper machine which also act as bearings for the roll.

The device 1 comprises a support frame 11 which has a belt grinder 12 and a drive motor 13 mounted on it, the drive motor 13 being in a driven connection with the belt grinder 12. Furthermore, three running rollers 14 are connected on either side of the end of the support frame 11. The alignment of the running rollers 14 is such that they are arranged in the circumferential direction of the body 2. The running rollers 14 are in a rotating mounting in a housing 16, which is located in an articulated connection with the support frame 11 by means of guide rods 15. The freedom of movement of the running rollers 14 in the vertical direction in relation to the external sleeve surface 3 is in each case adjustable by means of a servo device 27. Only the two guide rods 15 in the middle which hold the running rollers 14 are positioned in a fixed bearing in such a way that movement of the running rollers 14 perpendicular to the external sleeve surface 3 is prevented, in particular in the direction of the support frame 11.

The belt grinder 12 comprises two return rollers with a variable spacing in between them, thereby allowing the tension of the abrasive belt to be set. The return roller of the belt grinder 12 arranged in the support frame 11 is in contact with the external sleeve surface 3. The second return roller of the belt grinder 12 is held on the support frame 11 in such a way that the support frame 11 projects in the opposite direction to the direction of rotation of the body 2.

A calibration device 22 is attached to the support frame 11 in order to guarantee that the contact pressure of the belt grinder 12 against the external sleeve surface 3 is of sufficient magnitude to permit the areas of unevenness on the external sleeve surface 3 to be eliminated quickly and reliably and to achieve a precise, positionally accurate advance movement of the belt grinder 12; the free end of this calibration device 22, in other words the end of the calibration device 22 pointing away from the external sleeve surface, is assigned to a thrust bearing 21.

The thrust bearing 21 is located in a fixed position and is normally configured as a shaft. During normal operation of the paper machine, the shaft serves as a deflection point for felt or a similar carrier material which is required for drying the paper. The shaft can also be installed as an additional item.

Figure 3A:
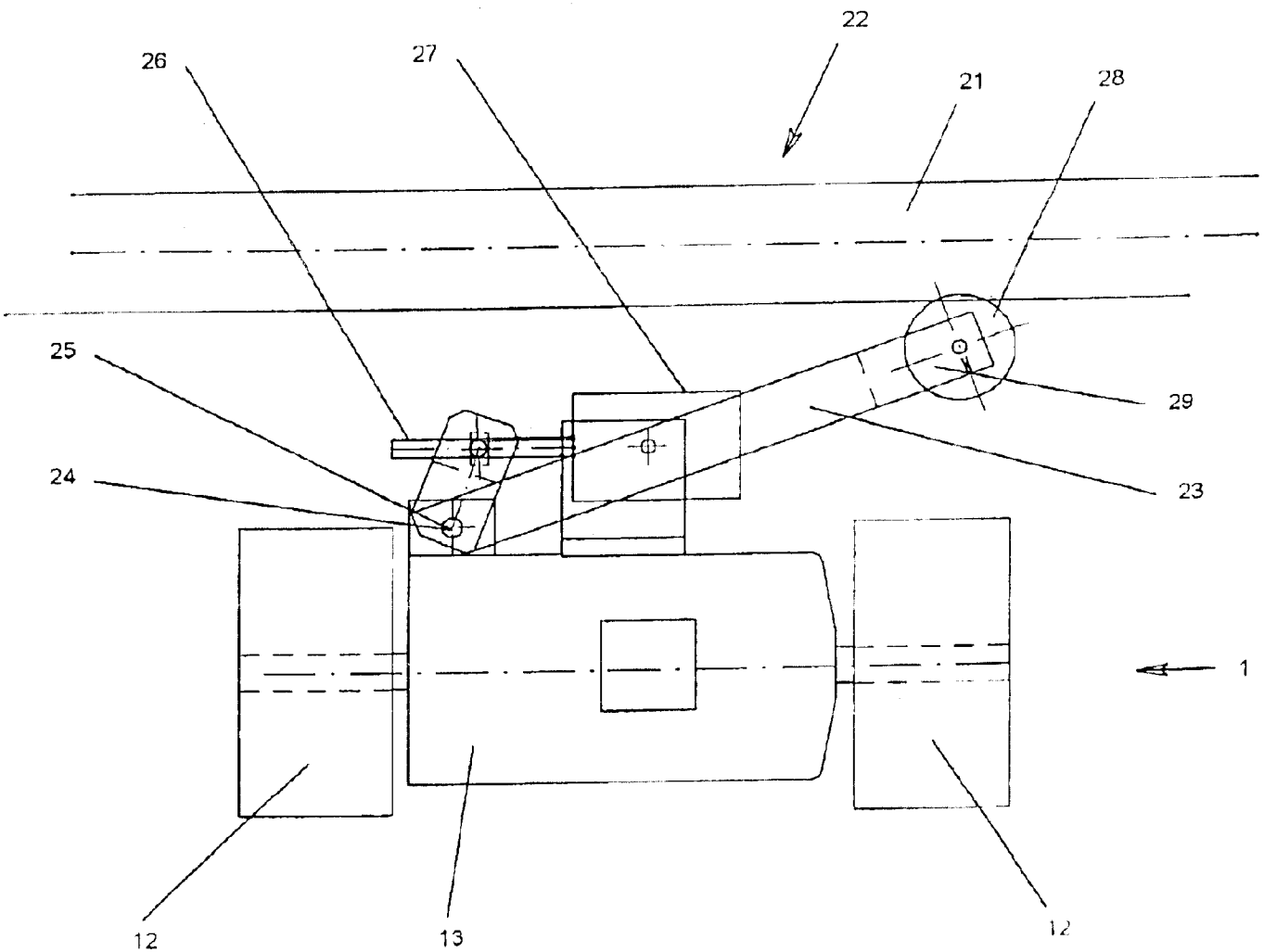
FIG. 3*a* shows a section through the device according to FIG. 1 in a lower advance position.
Figure 3B:
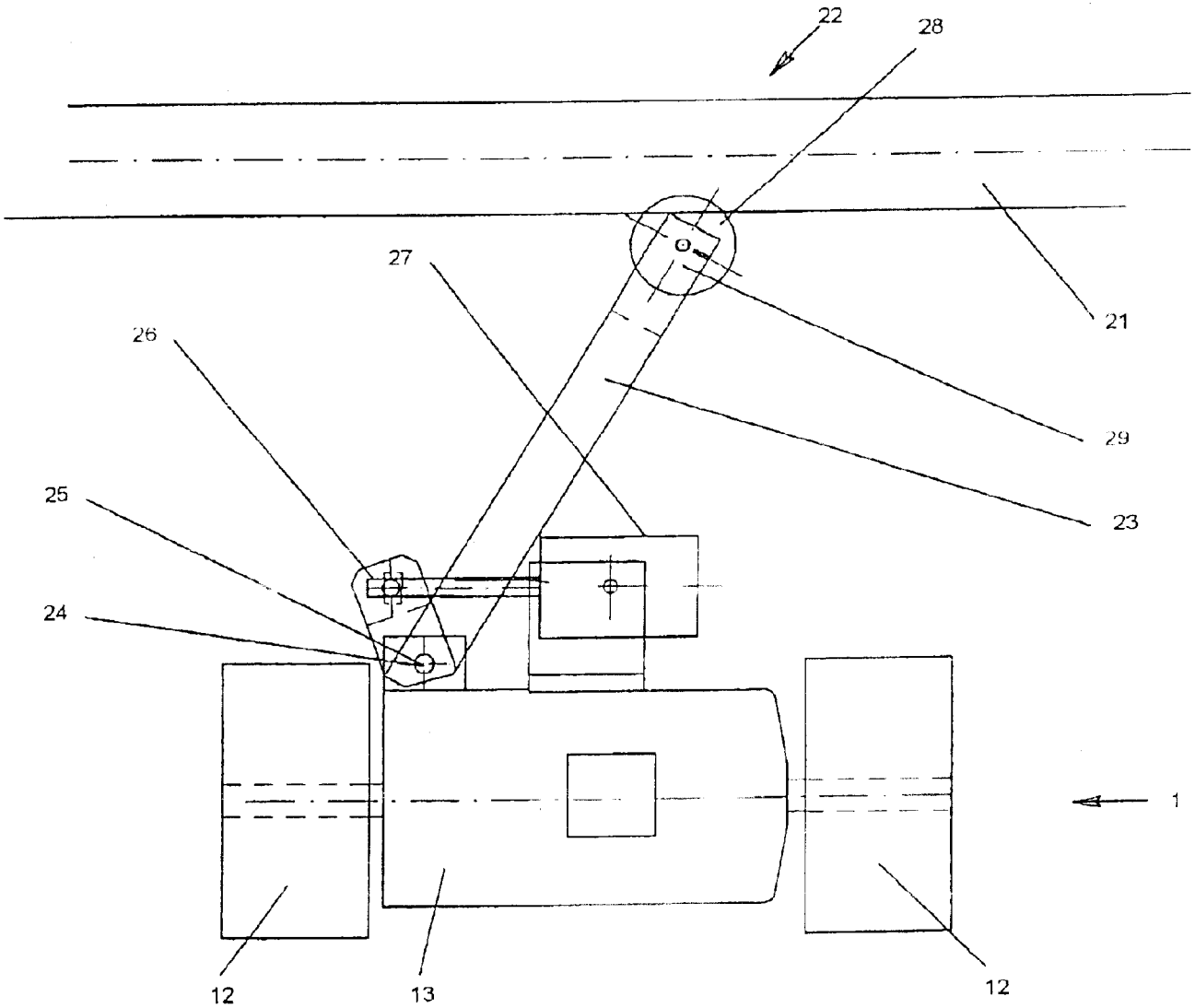
FIG. 3*b* shows a section through the device according to FIG. 1 in an upper advance position.

As can be seen in particular with reference to FIGS. 3*a* and 3*b*, the calibration device 22 comprises two struts 23 which carry a guide slide 29. Two rollers 28 are mounted in the guide slide 29. The external sleeve surfaces of the rollers 28 have a concave dished configuration, so that the rollers 28 make contact with differently sized diameters of the thrust bearings 21, since the contact points on the external sleeve surface of the rollers 28 vary depending on the diameter of the thrust bearing 21.

In accordance with FIGS. 3*a* and 3*b*, the calibration device 22 is supported against the thrust bearing by means of the rollers 28. The distance between the thrust bearing 21 and the external sleeve surface 3 can be variable in the direction of the longitudinal axis 4 so that it is necessary to allow for the height of the calibration device 22 to be adjusted. This is achieved in that the calibration device 22 possesses the two struts 23 which are located in a scissors connection with one another at a pivot point 25. Furthermore, a spindle 26 is articulated on each strut 23, with the spindle 26 acting in conjunction with the servo device 27. The spindle is articulated on an intermediate member which is located in a force-locking connection with the pivot point 25 of the struts 23. If the spindle 26 is accordingly moved in a horizontal direction due to actuation by the servo device 27, the intermediate member turns in the movement direction of the spindle 26 so that the corresponding strut 23 is moved in a vertical direction by means of the pivot point 25.

As a result, the distance between the thrust bearing 21 and the external sleeve surface 3 can be individually adjusted by the calibration device 22. Furthermore, the force of the servo device 27 enables the contact pressure of the belt grinder 12 on the external sleeve surface 3 to be set, since the calibration device 22 is directly attached to the belt grinder 12.

The respective maximum and minimum deflection positions of the calibration device 22 can be seen with reference to FIGS. 3*a* and 3*b*. Infinitely variable positioning to any point in between the two extreme positions is possible with the calibration device 22.

By way of example, FIG. 2 shows that two belt grinders 12 are attached to the support frame 11. In this case, the belt grinders 12 are arranged on the respective ends of the support frame 11 pointing in the direction of the longitudinal axis 4. As a result, the belt grinder 12 can also be moved to the respective outer areas of the body 2 which means that the entire length of the body 2 can be machined.

The running rollers 2 are arranged following the respective housing 16 in relation to the rotational direction of the body 2, with the effect that only tensile forces act on the running rollers 14 as a result of the rotation of the body. This means the running rollers 14 do not twist and there is no need for the housing to absorb torque. As a result, the direction of rotation of the body 2 defines the positioning of the running roller 14 in their housing 16.

Figure 4:
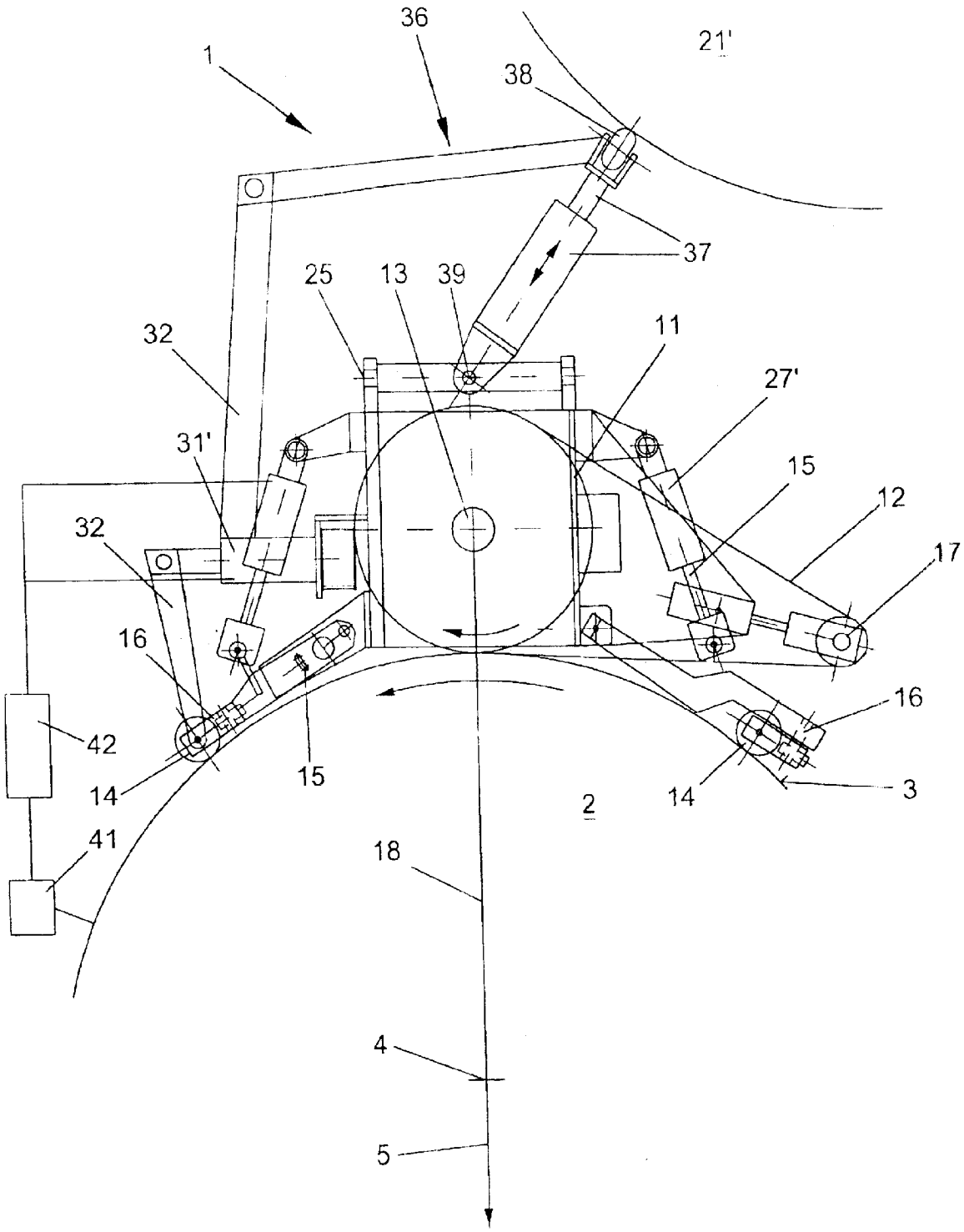
FIG. 4 shows a second embodiment of a device for grinding an external sleeve surface of a rotationally symmetrical body, as a side view

As shown in FIG. 4, the device 1 is placed on the external sleeve surface 3 of the body 2 in such a way that the weight axis 18 of the device 1 is in line with the weight axis 5 of the body 2. In the sample embodiment shown, the device 1 can be placed on the body 2 at a deflection angle of 0°—corresponding to in-line alignment—and with a deflection of up to 20° from the perpendicular, namely in the direction of the thrust bearing 21'. The further the device 1 is moved away from the perpendicular, the greater the contact force on the running rollers 14 arranged in the direction of the deflection. The running rollers 14 therefore support the device 1 laterally and are held perpendicular to the external sleeve surface 3 on the support frame 11 in a movable arrangement.

Due to the fact that both the body 2 and the belt grinder 12 rotate, a torque acting on the device 1 is created which, in the illustrated sample embodiment, is vectored towards the rotation of the belt grinder 12 since the speed of rotation of the belt grinder 12 is faster than the speed of rotation of the body 2. This torque would lead to the device 1 slipping off the external sleeve surface 3 of the body 2, so consequently the torque must be absorbed.

This is achieved in that a support member 36 is articulated on the support frame 11 of the device 1 in a pivoting bearing 39 providing a rotating connection which can be fixed in position. The support member 36 possesses a roller 38 on its free end, the roller 38 being in contact with a thrust bearing 21' located at an interval from the body 2. Usually, the thrust bearing 21' is another roll within the line of the paper mill. The position of the roller 38 on the thrust bearing 21' is freely adjustable. In order to be able to compensate for the variable clearance between the body 2 and the thrust bearing 21', the support member is formed from two tubes 37 arranged one inside the other in a telescopic configuration, it being possible to fix the tubes 37 in any position in relation to one another. It is particularly advantage ous if the longitudinal axis of the support member 36 is arranged perpendicular to the tangent running in line with the thrust bearing 21' at the contact point of the roller 38. However, the roller 38 is not allowed to make contact below a limit point, since then the support member 36 would slip off the thrust bearing 21'.

The position of the running rollers 14 on the external contour 3 of the body is at a lower height than the device 1, so that the running rollers 14 provide support for the device 1 with regard to the torque generated by the body 2.

Furthermore, a measuring device 41 is attached to the support frame 11 of the device 1, this measuring device 41 resting on the external sleeve surface 3 of the body 2 and recording the unevenness of the external sleeve surface 3. The measuring device 41 can also be held on an external support frame and be moved in parallel to the device 1.

The data recorded by the measuring device 41 are transferred to an evaluation and control unit 42 which is also attached to the support frame 11 of the device 1. The evaluation and control unit 42 is electrically connected to the servo devices 27' which act on the individual running rollers 14, so that the evaluation and control unit 42 can set the contact pressure of the belt grinder 12 against the external sleeve surface 3. This is achieved in that the servo devices 27' press the running rollers 14 against the external sleeve surface 3, with the effect that the belt grinder 12 is lifted off the external sleeve surface 3. However, if the running rollers 14 are lifted off the external sleeve surface 3, then the belt grinder 12 is pressed against the external sleeve surface 3 with practically the full weight of the device 1. As a result, the contact pressure of the belt grinder 12 is in between a value of zero and approximately the value of the weight of the device 1. Normally, the grinding force to be applied is between zero and 600 Newtons. The weight of the device 1 is between 2100 and 2500 Newtons.

The device 1 is to be moved along the longitudinal axis 4 of the body 2. This is achieved by means of a drive of the roller 38 which is supported against the thrust bearing 21'. To this end, an advance motor 31' is provided which is attached to the support frame 11 and is located in a driven connection with the roller 38 by means of a first cardan shaft 32. Furthermore, the advance motor 31' can also be in a driven connection with at least one of the running rollers 14 by means of a second cardan shaft 32, with the result that the running roller 14 is also driven. This has the effect of setting the body 2 in rotation by means of the running roller 14. As a result, there is no need for an additional drive for the device 1 or the body 2, since the movement of the device 1 and the rotation of the body 2 is directly produced by means of the advance motor 31'.

The drive of the device 1 in the direction of the longitudinal axis 4 acts as follows on the movement of the running rollers 14 which are aligned perpendicular to the movement direction of the device 1. The running rollers 14 slip along the external contour 3 of the body 2. However, since the advance movement of the device 1 in the direction of the longitudinal axis 4 is very slight—approximately comparable to the advance of a fine-pitch thread—is it possible for the running rollers 14 to slip along the body without any further measures being taken.

The evaluation and control unit 42 is electrically connected to the advance motor 31' and controls it. As a result, it is possible to generate exactly the required contact pressure depending on the position of the device 1 in relation to the external sleeve surface 3 of the body 2 and the device 1 can be moved along the longitudinal axis 4 of the body 2 in any direction with the result that the external sleeve surface 3 is machined as a function of the degree of unevenness measured in relation to the particular position of the device 1 on the body 2.

Figure 5:
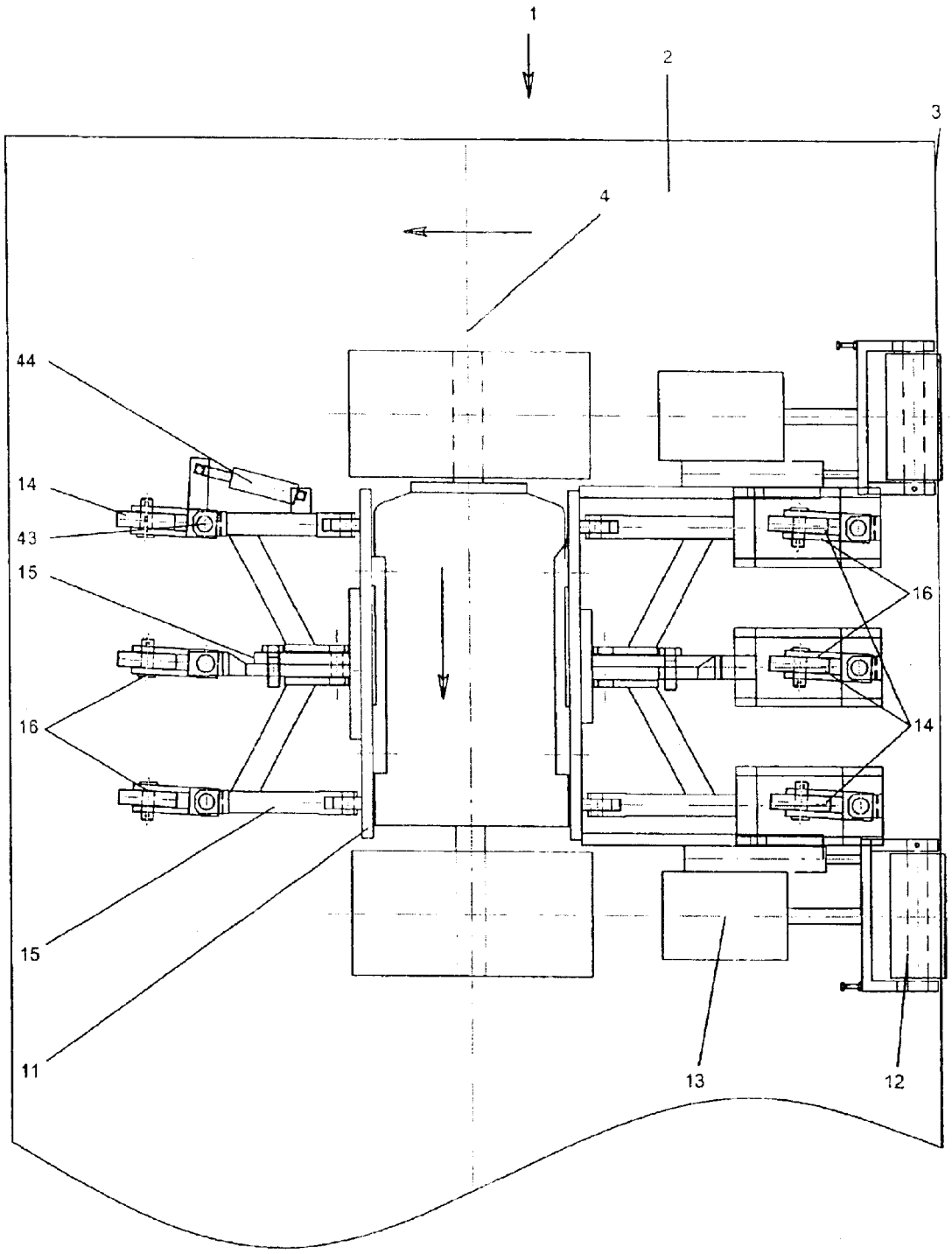
FIG. 5 shows a drive variant of the device according to FIG. 4, as a plan view.

FIG. 5 shows the device 1 moved in the direction of the longitudinal axis 4 of the body 2 due to the deflection of one of the running rollers 14. This is achieved in that the body 2 is set in rotation in the direction of the arrow. A pivot joint 43 is provided on one of the guide rods 15, by means of which the running roller 14 is articulated on the support frame 11. A servo device 44 is attached between the support joint 43 and the support frame 11, the servo device 44 enabling the running roller 14 to be pivoted from the perpendicular in relation to the longitudinal axis 4. As shown in FIG. 5, the running roller 14 is deflected in the direction of the servo device 44, so that the device 1 is moved clockwise in the direction of the arrow as a result of the rotation of the body 2.

However, if the servo device 44 is pushed in the direction of the running roller 14 then the device 1 moves in the direction opposite to the arrowed direction.

It is theoretically possible for all six of the running rollers 14 to be provided with the illustrated servo device 44 and to have them deflected accordingly in a synchronous operation. It is also possible to align two, three, four or five running rollers at a corresponding angle such that the device 1 is advanced as a result of the rotation of the body 2.

The diameter of the body 2 is normally 1500 mm; the advance movement generated by the deflection of the running roller 14 is approximately 50 mm, so that the non-deflected running rollers 14 slip over the external contour 3 of the body. With such a small amount of advance movement, the thread pitch is very low which means that sliding of the individual running rollers 14 does not have any detrimental effect on the operating smoothness of the device 1.

What is claimed is:

1. A device (1) for grinding an external sleeve surface (3) on a rotationally symmetrical body (2) the device comprising a support frame (11) movable along the external sleeve surface (3) of the body (2), at least one driven belt grinder (12) fixed on the support frame, a plurality of pivoted running rollers (14) disposed on the belt grinder and spaced in a circumferential direction of the body (2) and resting on the external sleeve surface (3) of the body (2), wherein a fixed thrust bearing (21) is assigned to the external sleeve surface (3) to be machined, a calibration device (22) is disposed between the thrust bearing (21) and said support frame (11) and is connected to said support frame and is braced against the thrust bearing (21), such that contact pressure acting on the external sleeve surface (3), and advance movement of the belt grinder (12) according to the unevenness of the external sleeve surface (3), and measured eccentricity of the body (2) can be adjusted using the calibration device (22).

2. The device in accordance with claim 1, wherein the thrust bearing (21) comprises a shaft and the length of the shaft corresponds to the length of the body (2) to be machined.

3. The device in accordance with claim 1, wherein the calibration device (22) is in a driven connection with an advance motor (31'), and the device (1) is movable in the direction of the longitudinal axis (4) of the body (2) by means of the calibration device (22).

4. The device in accordance with claim 1, wherein three of the running rollers (14) running in parallel with one another are articulated on either side adjacent to the support frame (11) and are mounted in a U-shaped housing (16) so as to rotate, and each of the housings (16) is connected to the support frame (11) by means of a guide rod (15).

5. The device in accordance with claim 4, wherein each of the guide rods (15) of the housings is held onto the support frame (11) by means of a fixed bearing such that a middle running roller (14) can be held in a fixed position perpendicular to the external sleeve surface (3).

6. The device in accordance with claim 5, wherein two of the guide rods (15) of the running rollers (14) are arranged in a selected direction of the body (2) and the support frame (11) and are articulated in a rotating connection.

7. The device in accordance with claim 4, wherein the running rollers (14) in their respective housings (16) are in a successive arrangement in relation to the direction of rotation of the body (2).

8. The device in accordance with claim 1, wherein a reversing roller (17) of the belt grinder (12) is held protruding opposite to the direction of rotation of the body (2).

9. The device in accordance with claim 1, wherein two belt grinders (12) are attached to the support frame (11) and the belt grinders (12) are arranged on two lateral ends of the support frame (11) extending in the direction of the longitudinal axis of the body.

10. The device in accordance with claim 9, wherein the belt grinders (12) can be independently controlled and driven.

11. The device in accordance with claim 1, wherein the body (2) to be machined can be driven by at least one of the running rollers (14).

12. The device in accordance with claim 11, wherein the driven running roller (14) is connected to an advance motor.

13. The device in accordance with claim 1, wherein the calibration device (22) is directly articulated on the belt grinder (12).

14. The device in accordance with claim 1, wherein the calibration device (22) comprises two struts (23) located in a scissors arrangement in relation to one another and connected together by a joint, the struts (23) comprising two tubes arranged one inside the other in a telescopic configuration, and a controllable servo device (27) for changing position of the struts (23).

15. The device in accordance with claim 1, wherein the calibration device (22) is connected to at lest one guide slide (29) in which one or more rollers (28) are mounted in a rotating arrangement, and external sleeve surfaces of the rollers (28) comprise dished concave surfaces.

* * * * *